US005826230A

United States Patent [19]

Reaves

[11] Patent Number: 5,826,230

[45] **Date of Patent: *Oct. 20, 1998**

[54] SPEECH DETECTION DEVICE

[75] Inventor: Benjamin Kerr Reaves, Yamatotakada, Japan

[73] Assignees: Matsushita Electric Industrial Co., Ltd., Osaka, Japan; Panasonic Technologies, Inc., Princeton, N.J.

[ * ] Notice: The term of this patent shall not extend beyond the expiration date of Pat. No. 5,617,508.

[21] Appl. No.: 615,320

[22] PCT Filed: Jul. 18, 1994

[86] PCT No.: PCT/JP94/01181

§ 371 Date: Mar. 18, 1996

§ 102(e) Date: Mar. 18, 1996

[87] PCT Pub. No.: WO96/02911

PCT Pub. Date: Feb. 1, 1996

[51] Int. Cl.[6] ..... G10L 5/06; G10L 9/00

[52] U.S. Cl. ..... 704/233; 704/248; 704/253

[58] Field of Search ..... 704/248, 233, 704/253

[56] References Cited

U.S. PATENT DOCUMENTS 4,441,203 4/1984 Fleming .

5,579,431 11/1996 Reaves ..... 704/233

5,617,508 4/1997 Reaves ..... 704/248

FOREIGN PATENT DOCUMENTS 0 111 947 6/1984 European Pat. Off. .

0 138 071 4/1985 European Pat. Off. .

0 167 364 1/1986 European Pat. Off. .

*Primary Examiner*—David R. Hudspeth

*Assistant Examiner*—Robert Louis Sax

*Attorney, Agent, or Firm*—Ratner & Prestia

[57] ABSTRACT

The device detects the beginning and ending portions of speech contained within an input signal based on the variance of smoothed frequency band limited energy and the history of the smoothed frequency band limited energy within the signal. The use of the variance allows detection which is relatively independent of an absolute signal-to-noise ratio with the signal, and allows accurate detection within a wide variety of backgrounds such as music, motor noise, and background noise, such as other voices. The device can be easily implemented using off-the-shelf hardware along with a high-speed special purpose digital signal processor integrated circuit.

35 Claims, 6 Drawing Sheets

SPEECH DETECTION DEVICE

TECHNICAL FIELD

The invention generally relates to a device for the detection of the start and end of a segment containing speech within an input audio signal which contains both speech segments and nonspeech noise or background segments.

BACKGROUND ART

Detection of speech in real time is a necessary component for many devices, including but not limited to voice activated tape recorders, answering machines, automatic speech recognizers, and processors for removing speech from music. Many of these applications have noise inseparably mixed with speech. Detection of speech requires a more sophisticated speech detection capability than provided by conventional devices that simply detect when energy level rises above or falls below preset threshold.

In the field of automatic speech recognition, the speech detection component is most critical. In practice, more speech recognition errors arise from errors in speech detection than from errors in pattern matching, which is commonly used to determine the content of the speech signal. One proposed solution is to use a word spotting technique, in which the recognizer is always listening for a particular word. However, if word spotting is not preceded by speech detection, the overall error rate can be high.

Many speech detection devices are based on a certain parameter of the input, such as energy, pitch, and zero crossings. The performance of the speech detector depends heavily on the robustness of that parameter to background noise. For real time speech detection, the parameters must be quickly extracted from the signal.

DISCLOSURE OF INVENTION

One of the objects of the present invention is to provide a device for the detection of speech which is capable of operation at a speed fast enough to keep up with the arrival of the input, i.e., real time.

Another object of the present invention is to provide a device for the detection of speech that can be implemented with a conventional digital signal processing circuit board.

Another object of the present invention is to provide a device for the detection of speech which is effective despite various types of noise mixed with the speech.

Another object of the present invention is to provide a speech detection device for various applications, including but not limited to: isolated word automatic speech recognizers, continuous speech recognizers (to detect pauses between phrases of sentences), voice controlled tape recorders, answering machines, and the processing of voice embedded in a recording with background noise or music.

These and other objects of the invention are achieved by the provision of a device for detecting speech in an input signal which includes means for determining a value representative of the smoothed frequency band limited energy within the signal, means for determining a variance of the value representative of the smoothed frequency band limited energy of the signal, and means for determining the beginning and ending points of speech within the signal based on the variance of the smoothed frequency band limited energy and the history of the band limited energy.

The invention exploits the variance in the smoothed frequency band limited energy and the history of the smoothed frequency band limited energy to detect the beginning and end of speech within an input speech signal. Variance of the smoothed frequency band limited energy is employed based on the observation that foreground speech occurring in a difficult background, such as a lead vocalist against a background of music, yields a noticeable fluctuation of the energy level above a "noise floor" of relatively low fluctuation. This effect occurs although the level of the background may be high. Variance quantifies that fluctuation of energy.

In accordance with the preferred embodiment, the device calculates smoothed frequency band limited energy using a Hamming window and a Fourier transform. The variance is calculated as a function of time from smoothed frequency band limited energy values stored in a shift register. To determine the beginning and ending points of speech, the device compares the smoothed frequency band limited energy to a predetermined energy threshold, and the variance as a function of time to two predetermined threshold levels, an upper variance threshold level and a lower variance threshold level. If the smoothed frequency band limited energy exceeds the energy threshold, the device tentatively determines that speech has begun.

However, if after a specified amount of time the variance does not subsequently rise above the upper variance threshold level, then the tentative determination of the beginning of speech is discarded. During the time between the smoothed frequency band limited energy's exceeding the energy threshold and the variance's exceeding the upper variance threshold, the device characterizes the signal as being in a beginning (B) speech state. Once the variance exceeds the upper threshold level, the device characterizes the signal as being within a speech (S) state. Finally, the ending point of the speech is determined when the variance falls below the lower variance threshold level.

Alternatively, the recent history of the smoothed frequency band limited energy and its variance as a function of time are used as input to a trained Neural Network, and its single binary output signifies whether speech is or is not in progress.

By employing upper and lower threshold levels for testing the variance, the error rate in detecting speech is minimized. By using the level of the smoothed frequency band limited energy to tentatively determine the starting point, the delay between the true onset of speech and the reaction of the speech detection device is minimized. By using a Neural Network to signify whether speech is present, the device can detect speech in many various types of noise.

Preferably, the device is implemented within integrated circuit hardware such that the processing of the input signal to determine the beginning and ending points of speech based on the variance of the smoothed frequency band limited energy and the history of the smoothed frequency band limited energy can be performed in real time.

BRIEF DESCRIPTION OF DRAWINGS

The exact nature of this invention, as well as its objects and advantages, will become readily apparent upon reference to the following detailed description when considered in conjunction with the accompanying drawings, in which like reference numerals designate like parts throughout the figures thereof, and wherein.

BEST MODE FOR CARRYING OUT THE INVENTION

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a speech detection device which detects the beginning and ending points of speech based on the variance of the smoothed frequency band limited energy of an input signal.

Figure 1:
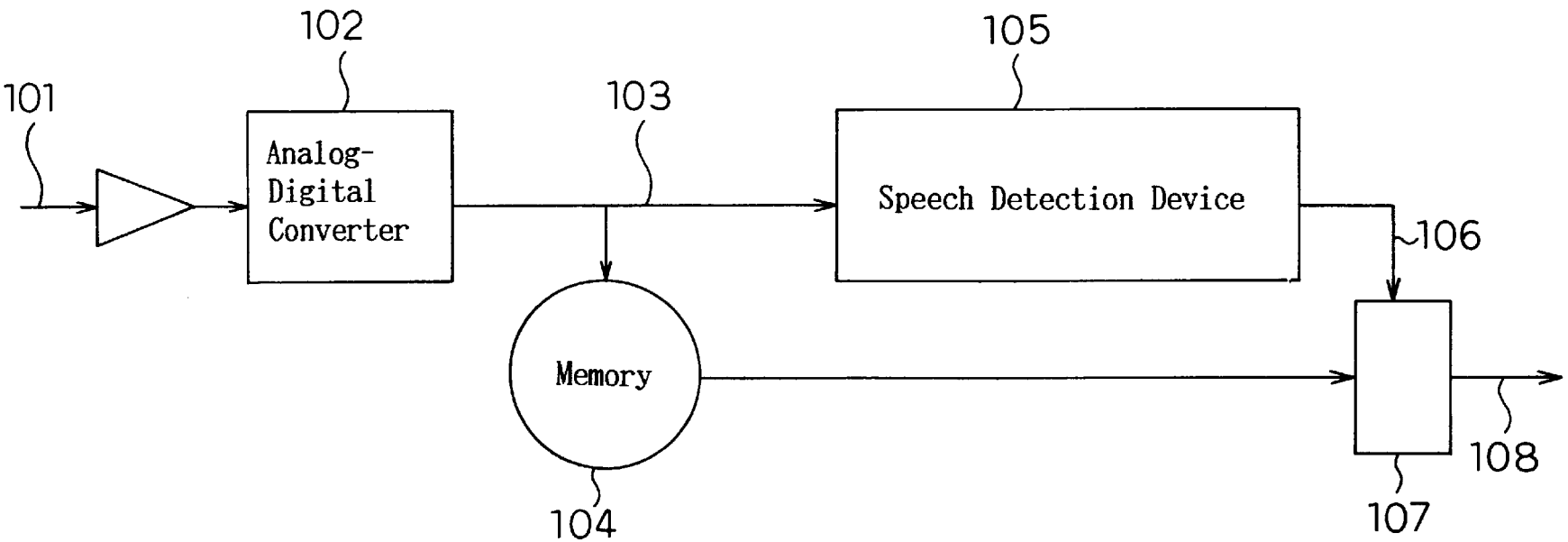
FIG. 1 provides a block diagram of an automatic speech recognizer, employing a speech detection device in accordance with a preferred embodiment of the invention.

A preprocessor for an isolated word automatic speech recognition system using the present invention is illustrated in FIG. 1. Analog input 101, from a microphone, is voltage-amplified and converted to digital form by an analog-to-digital converter 102 at a rate equal to a sampling frequency (typically 10,000 samples per second). A resulting digital signal 103 is saved in a memory area 104 that can store up to 6.5536 seconds of speech — a period longer than any single word utterance. If the capacity of 104 is exceeded, then old data are erased as new data are saved. Thus, 104 contains the most recent 6.5536 seconds of input data. The digital signal 103 also serves as input to a speech detection device 105. An output decision signal 106 triggers a gate 107 to pass a portion of memory 104 which has been determined by 105 to contain speech, to an output 108. For different applications, the length of buffer 104 can be modified and, in some applications such as an answering machine, buffer 104 can be eliminated and signal 106 can control a tape drive directly. Alternatively, buffer 104 may be simply a delay line of several milliseconds.

Figure 2:
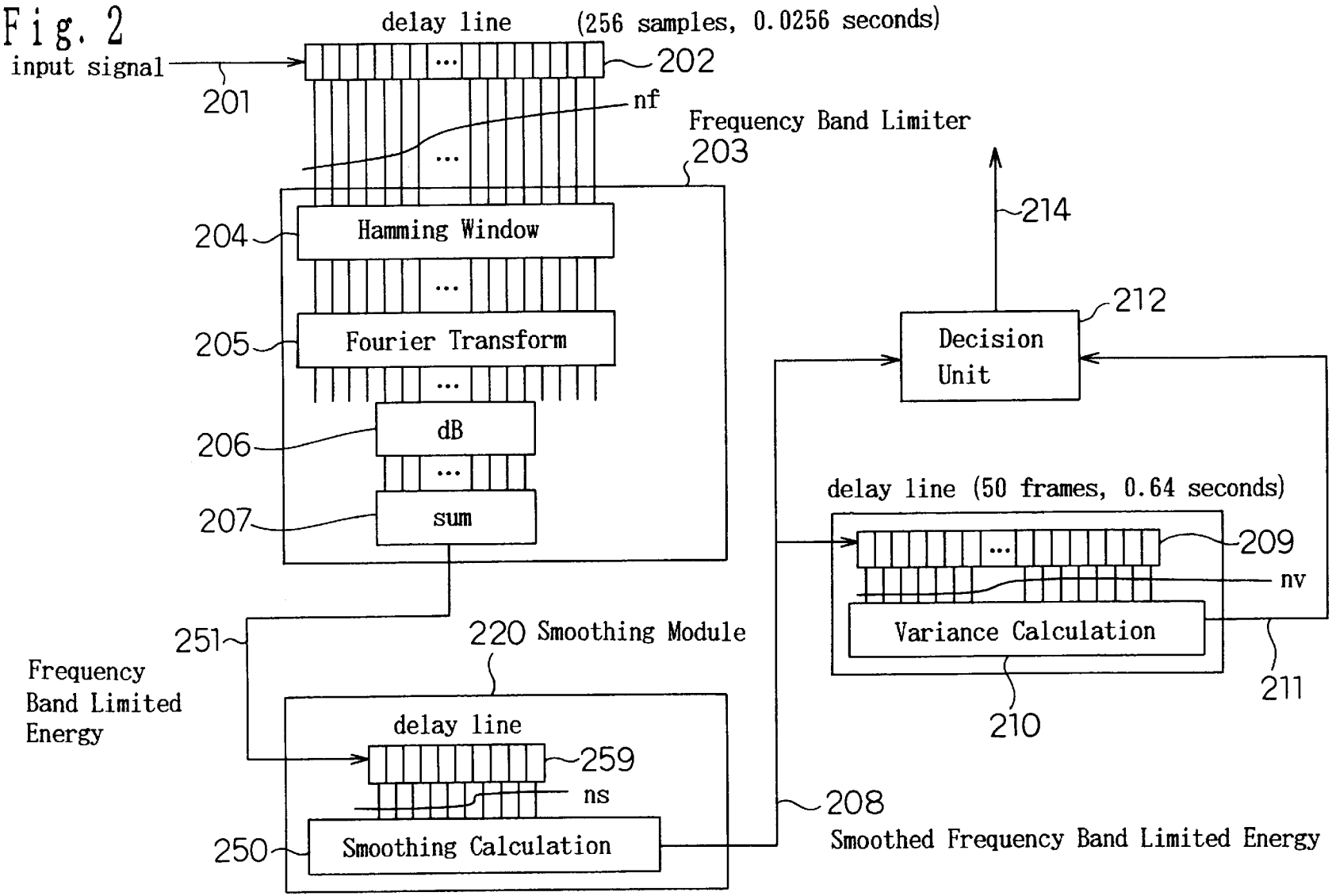
FIG. 2 is a block diagram of the speech detection device of FIG. 1.

Speech detection device 105 is illustrated in detail in FIG. 2. The digital input signal 103 of FIG. 1 is shown as input signal 201 if FIG. 2. Signal 201 enters a delay line that keeps nf consecutive samples of the input (e.g. 256). When it is filled, a frequency band limiter 203 starts processing the signal. When nf/2 (e.g. 128) new samples of input data 201 have been received, a delay line 202 shifts 128 samples to the right,erasing the 128 oldest samples, and fills the left half with 128 new samples. Thus, shift register 202 always contains 256 consecutive samples of the input and overlaps 50% with the previous contents. The unit of time for the 128 new samples to be ready is a frame, and one frame is, e.g., 0.0128 seconds.

The frequency band limited energy is calculated in 203. After multiplying elements of the delay line by a Hamming window 204, a Fourier transform, 205, extracts the frequency spectrum of the contents of 202. The spectral components corresponding to frequencies between 250 Hz and 3500 Hz, the band that contains the most important speech information, are converted to units of decibels by 206, and are summed together in 207, producing the frequency band limited energy, shown as signal 251 in FIG. 2.

Alternatively, the frequency band limited energy may be calculated by a method other than summing the portions of a frequency spectrum converter. For example, the input signal may be digitally filtered by convolution or by passing through a recursive filter, and its energy may be measured by a method described below. This would replace 202 and all of 203 of FIG. 2.

Also, band limiting may be performed in the analog domain, with the energy obtained directly from an analog filter, or by a method described below. The analog band limiter may consist of a band-pass filter, a low pass filter, or another spectral shaping filter, or may arise from frequency limiting inherent in an amplifier or microphone, or may take the form of an antialiasing filter. The energy may be obtained directly from the filter or by a method described in the following paragraph. The signal resulting from either of these alternative techniques is hereafter referred to as the frequency band limited signal.

Any quantity that varies generally monotonically with the energy of the frequency band limited energy is hereafter called the frequency band limited energy. Instead of the method described in FIG. 2, the frequency band limited energy may be calculated by: (a) calculating the variance of the frequency band limited signal over a short period of time; (b) summing the absolute value, magnitude, rectified value, or square of other even power of the frequency band limited signal over a short period of time; or (c) determining the peak of the value, the magnitude, the rectified value, or square of other power of the frequency band limited signal over a short period of time.

Continuing with the preferred embodiment of the invention, frequency band limited energy is smoothed by the Smoothing Module, 220. The frequency band limited energy first enters a delay line 259. At every frame, in this example 12.8 milliseconds, this delay line receives a new sample and shifts the remaining samples to the right by one. Its length in this example is 10 frames, corresponding to 0.128 seconds. A shorter length decreases the response time of the speech detection device; a longer length makes the device stronger against impulsive noises.

Smoothing calculation unit 250 calculates the mean value of the contents of the delay line 259, and that value is the smoothed frequency band limited energy, 208.

Alternatively, the smoothing calculation 250 may be performed by calculating the median of the values in the delay line 259, or by calculating any function that has the effect of smoothing, or otherwise suppressing short, impulsive variations of the contents of the delay line 259. In the degenerate case, the length of the delay line 259 can be one, and signal 251 can be passed directly to the output 208, so that the smoothed frequency band limited energy, 208, is the same as the frequency band limited energy, 251.

The smoothed frequency band limited energy enters a delay line 209. Because the smoothing calculation 250 has the effect of removing rapid changes in the contents of delay line 259, the delay line 209 for the variance calculation may receive new values at a rate slower than once per frame. It shifts right by one when each new entry arrives. A longer delay line would allow longer pauses within the utterance before declaring the speech to have ended; a shorter delay line would speed up the speech detector's response to the end of speech. The length of this delay line 209 is nv, which in this example is 40, corresponding to a pause length of 0.51 seconds:

$$nv = \frac{(\text{pause length}) \times (\text{sampling frequency})}{(nf/2)}$$

Variance calculation unit 210 calculates the variance of the values in delay line 209. V, the variance of the smoothed frequency band limited energy, is:

$$V = g(A,B)$$

where $$g(A, B) = \frac{A}{nv} - \frac{B \times B}{nv \times nv}$$

and $$A = \sum_{f=1}^{f=nv} (BLE(f) \times BLE(f))$$

and $$B = \sum_{f=1}^{f=nv} BLE(f)$$

and

V is the output 211 of the variance calculation 210; and

BLE(f) is the contents of delay line 209 at locations $$f = nv, \ldots, 3, 2, 1;$$

BLE(l) is the oldest BLE value; and BLE is the smoothed frequency band limited energy;

and

Figure 4:
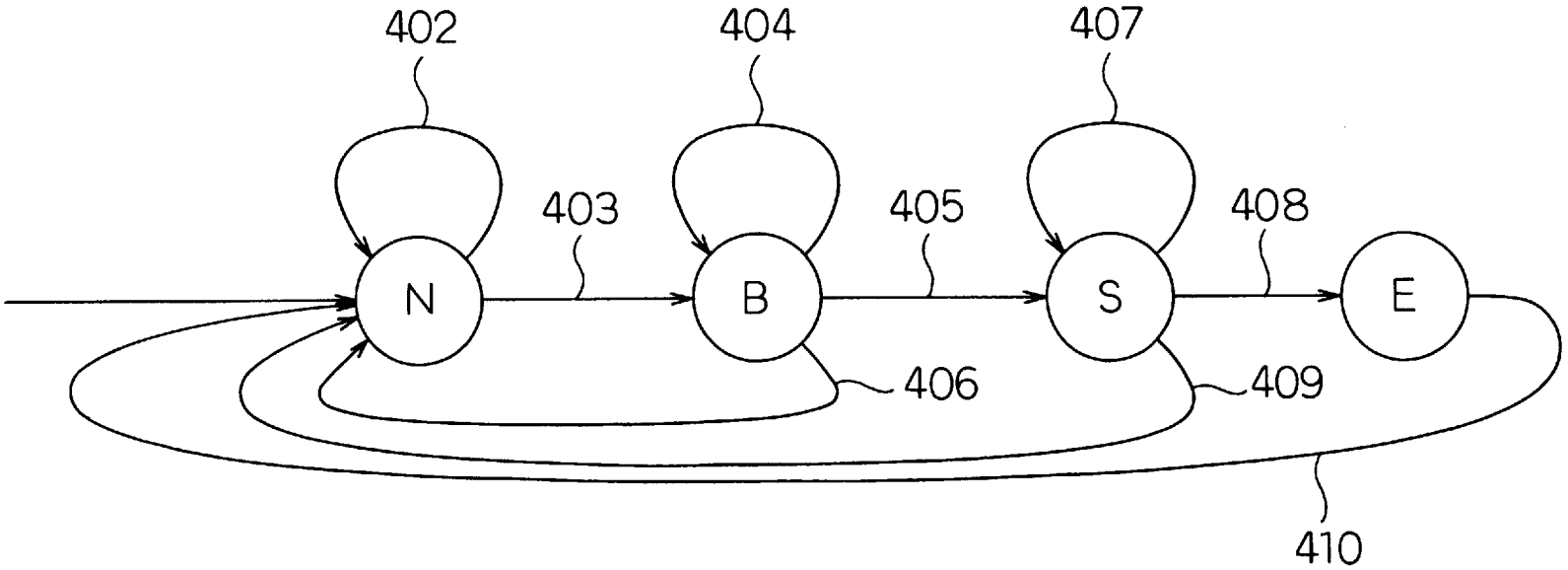
FIG. 4 is a state diagram illustrating the speech detection device of FIG. 2.
Figure 5:
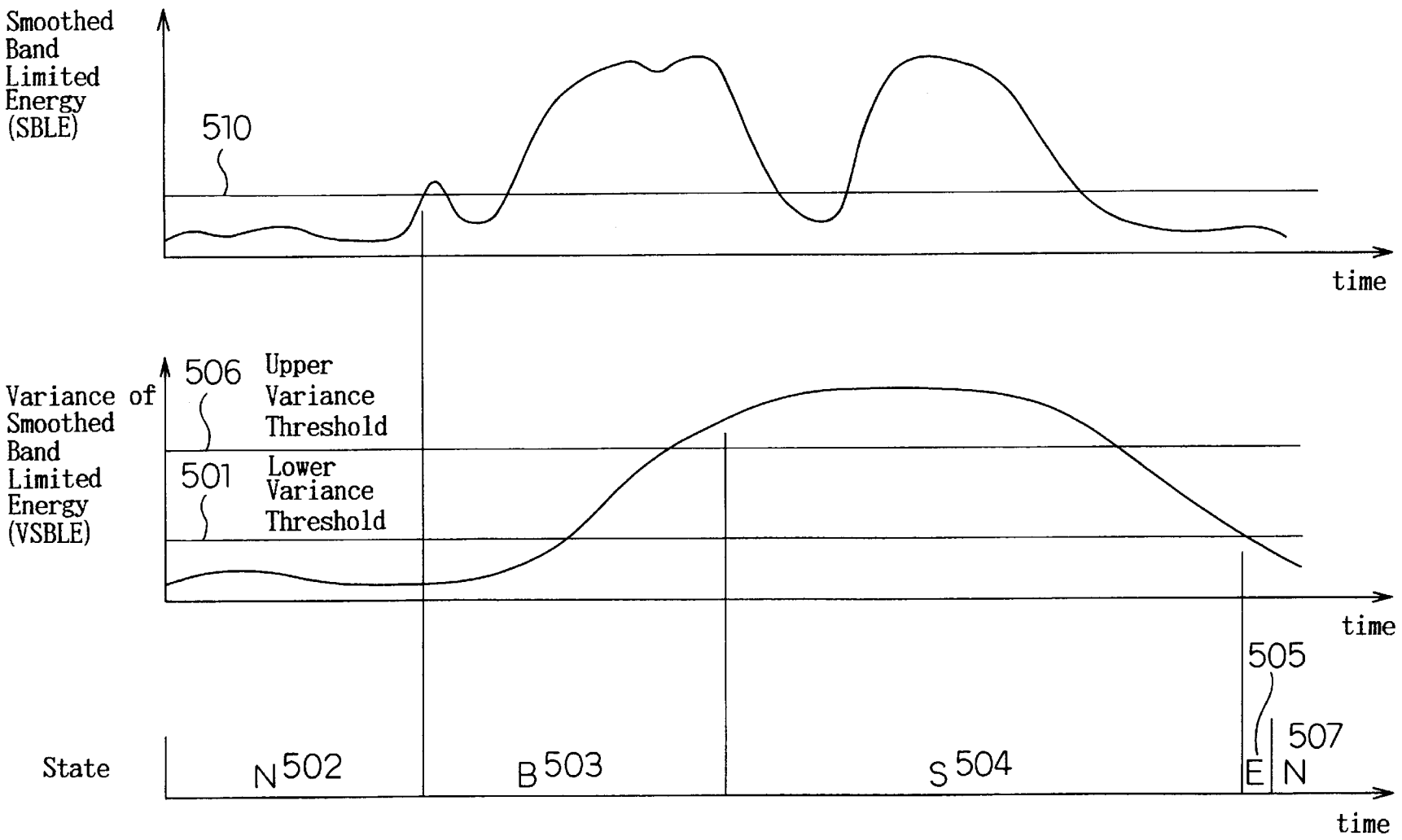
FIG. 5 is an exemplary input signal.

The variance 211 and the smoothed filtered band limited energy 208 drive the decision unit 212, the operation of which is shown in FIGS. 4 and 5.

Figure 3:
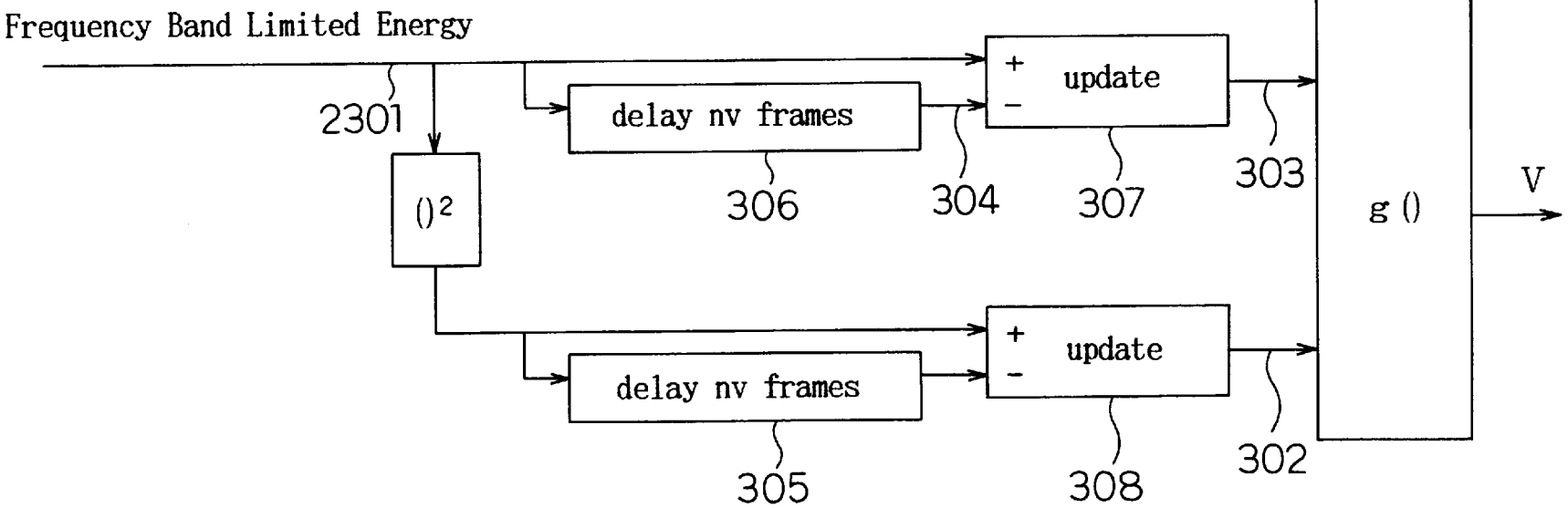
FIG. 3 provides a flow chart illustrating a method for determining the variance of the smoothed frequency band limited energy employed by the speech detection device of FIG. 1.

FIG. 3 shows a faster way to calculate the variance V, replacing the variance calculation 210 and delay line 209. This faster technique updates, rather than recalculates, quantities A and B as follows. Here, 307 and 308 are updating means.

$$A' = A + [BLE(nv) \times BLE(nv)] - [BLE(0) \times BLE(0)]$$

$$B' = B + BLE(nv) - BLE(0)$$

where

A' is the updated value for A, shown as 302, and

B' is the updated value for B, shown as 303, and

BLE(nv) is the newest smoothed frequency band limited energy, 301, from 208 of FIG. 2, and BLE(0) is the oldest smoothed frequency band limited energy, 304.

The square of BLE is delayed in the delay line 305. This delay line can be removed and replaced by squaring the value from 304. The delay lines 305 and 306 should be cleared to zero upon initialization. Also, note that the delay lines 306 and 305 are one longer than delay line 209 of FIG. 2.

Figure 6:
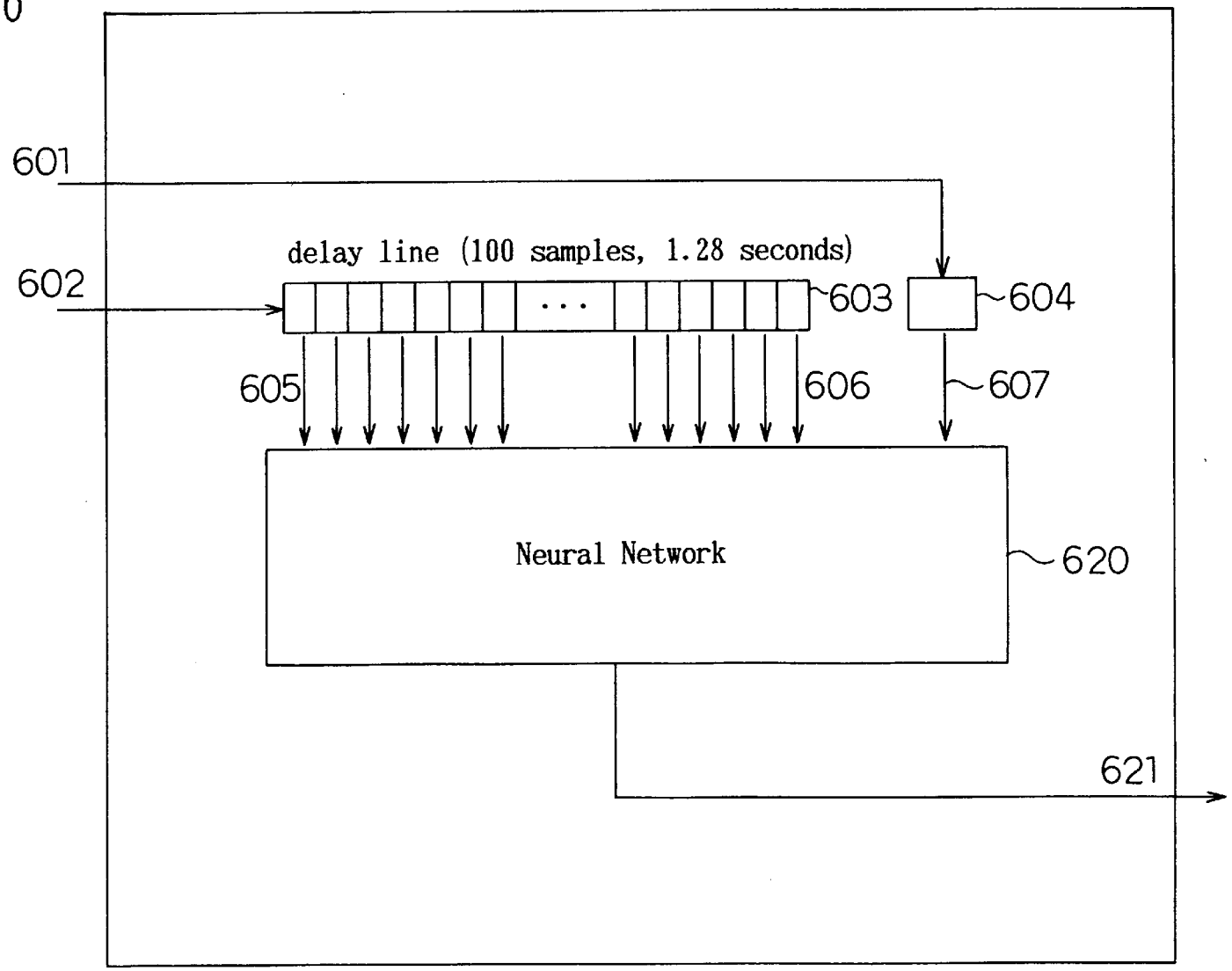
FIG. 6 is a block diagram of one decision unit of FIG. 2 in the second embodiment, illustrating the use of the Neural Network in determining the start and end point of speech.

FIG. 6 shows a block diagram of the Decision Unit (212 in FIG. 2) using a Neural Network. The inputs to the Neural Network, 620, are some samples 605,606 of the frequency band limited energy from the previous 1.28 seconds of speech, and the variance of the smoothed frequency band limited energy. Delay Line 603 stores up the past 1 second of smoothed frequency band limited energy, 602, and register 604 stores the variance of frequency band limited energy, 601. The output of the Neural Network, 621, is a binary decision signifying whether the current frame contains speech or not. This corresponds to 214 of FIG. 2.

Alternatively, the Decision Unit can use a thresholding approach. FIG. 4 shows a state diagram for a Decision Unit that uses the Variance (211 in FIG. 2) and the Energy (213 in FIG. 2) to detect the existence of speech. FIG. 5 shows an example of a the smoothed frequency band limited energy, SBLE, and the variance of the smoothed frequency band limited energy of a speech signal, VSBLE, and corresponding states, as an aid in understanding the state diagram. At each frame, 0.0128 seconds in this example, a transition in the state diagram is taken.

The state diagram begins in the N— or Noise— state (502). As long as the SBLE is below the Energy Threshold 510, transition 402 is taken, and state N is not exited. When SBLE rises above the Energy Threshold 510, transition 403 is taken, and state B (tentative beginning of speech, 503) is entered. Thus, the energy is used to quickly trigger the device. When state B is entered, the device determines that the speech started a few milliseconds past. This amount of time, z, is typically equal to the length of the delay line 259.

For a preset amount of time, state B will not be exited: transition 404 is taken. If this time is too short, the start point estimate will be too late and the head of the speech will be cut; as this time gets longer, the speech detector's response to the start of speech becomes delayed, though not inaccurate; if it is longer than the length of delay line 209, the device may miss the speech completely. In this example, the time is 175 milliseconds. At the end of this time, VSBLE is tested to see whether it has exceeded 506, the Upper Variance Threshold, and state B is exited. If VSBLE is below the Upper Variance Threshold, transition 406 is taken, the tentative start point is discarded, and the device returns to the N state. If VSBLE is above the Upper Variance Threshold, 506, then transition 405 is taken and the device enters the S state, 504, which means that it has decided that speech has been and currently is entering the device.

As long as VSBLE stays above the Lower Variance Threshold 501, transition 407 is taken and state S is not exited. When VSBLE drops below the Lower Variance Threshold, transition 408 brings the device to the E state 505, which signals that the end of speech has been detected. The end of speech is determined to be at the point where SBLE falls below the energy threshold for the last time before the E state is entered. At the next frame, the device returns to the N state 507 via transition 410.

If the device after gate 107 of FIG. 1 is an Automatic Speech Recognizer, then by passing the current state on line 214 of FIG. 2, connecting it to 106 of FIG. 1, to control the gate, 107, the automatic speech recognizer can process the incoming speech in real time. The only delay will be the time taken by the speech detector to determine the Start Point. If speech can be passed to the automatic speech recognizer at state B, i.e., if the gate or the recognizer has the ability to cancel the incoming speech in case transition 406 is taken, then the automatic speech recognizer can start processing the speech with a delay about equal to the length of Delay Line 259.

What has been described is a device for detecting the presence of speech within an input signal. The device calculates the beginning and the ending points of speech based on the variance of the smoothed frequency band limited energy within the signal. By utilizing the variance of the smoothed frequency band limited energy, the presence of speech is effectively detected in real time. The device is particularly useful for detecting a segment of a recording that contains speech, such that the segment can be extracted and further processed.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. A device for detecting speech in an input signal comprising:

means for determining a value representative of smoothed frequency band limited energy within the signal;

means for determining a variance of smoothed frequency band limited energy; and means for determining the beginning and ending points of speech within the signal based on the variance of the smoothed frequency band limited energy and past history of the smoothed frequency band limited energy.

2. The device of claim 1, wherein the means for determining the value representative of the smoothed frequency band limited energy comprises:

means for determining frequencies associated with the signal;

means for selecting portions of the signal having frequencies within a preselected range;

means for determining a value representative of the total energy within the selected portions of the signal, the value representative of total energy being the frequency band limited energy; and means for smoothing the frequency band limited energy, the value being the smoothed frequency band limited energy.

3. The device of claim 1, wherein the means for determining the value representative of the smoothed frequency band limited energy comprises:

means for applying a Hamming window filter to a portion of the signal to generate a filtered signal;

means for applying a Fourier Transform to the filtered signal to generate a transformed signal;

means for summing the transformed signal to generate a value representative of the total energy in the portion of the signal, the value representative of the energy of the signal being the frequency band limited energy; and means for applying a filter to the frequency band limited energy, the result being the smoothed frequency band limited energy.

4. The device of claim 1, wherein the device includes:

means for receiving the speech signal;

means for storing a portion of the signal covering a continuous period of m seconds; and means for updating the stored portion of the signal as new signals are received.

5. The device of claim 4, wherein m is between 0 and 10 seconds.

6. The device of claim 4, wherein the means for storing the portion of the signal comprises a shift register.

7. The device of claim 1, wherein the means for determining the variance of the smoothed frequency band limited energy comprises:

means for storing a plurality of values representative of the smoothed frequency band limited energy, the values being stored as a function of time;

means for calculating variance, V, wherein V is given by V=g(A, B); where

BLE(f) represents the plurality of values of smoothed frequency band limited energy, nv is the number of values, f=nv, . . . , 3, 2, 1; and BLE(1) is an oldest BLE value.

8. The device of claim 7, wherein the means for determining the variance of smoothed frequency band limited energy further comprises:

means for calculating V=g(A', B') as new values of BLE(nv) are received, where $$A'=A+[BLE(nv)\times BLE(nv)]-[BLE(0)\times BLE(0)];$$

$$B'=B+BLE(nv)-BLE(0);$$

where

A' is an update value for A,

B' is an update value for B, and

BLE(nv) is a newest smoothed frequency band limited energy, and

BLE(0) is an oldest smoothed frequency band limited energy.

9. The device of claim 1, wherein the means for determining the beginning and ending points of speech within the speech signal based on the variance of the smoothed frequency band limited energy comprises:

means for determining a beginning of speech (B) as occurring when the smoothed frequency band limited energy exceeds a predetermined energy threshold level and means for determining an ending of speech (E) as occurring when the variance of smoothed frequency band limited energy falls below a predetermined lower variance threshold level.

10. The device of claim 9, wherein the energy threshold level and the lower variance threshold level are predetermined, and wherein the beginning (B) of the speech signal is determined as a point in time z seconds before the smoothed frequency band limited energy initially exceeds the energy threshold level.

11. The device of claim 10, wherein z is between 0 and 100 seconds.

12. The device of claim 9, wherein upper and lower threshold levels are predetermined, and wherein the ending point (E) of the speech signal is determined as a point in time z seconds before the variance falls below the lower variance threshold level.

13. The device of claim 12 wherein z is between 0 and 100 seconds.

14. The device of claim 9, wherein the ending point (E) of the speech signal is determined as the point in time at which the smoothed frequency band limited energy falls below the energy threshold level for the last time before the variance of smoothed band limited energy falls below the lower variance threshold level.

15. The device of claim 1, wherein the means for determining the beginning and ending points of speech within the speech signal based on the variance of smoothed frequency band limited energy and history of smoothed frequency band limited energy comprises a trained neural network.

16. The device of claim 9, wherein the beginning point of speech is rejected if, within t seconds after the smoothed frequency band limited energy exceeds the energy threshold, the variance of smoothed frequency band limited energy does not exceed the upper variance threshold.

17. The device of claim 16, wherein t is between 0 and 10 seconds.

18. In a device for detecting speech within an input signal, with the device having means for receiving a speech signal, and means for determining the beginning and ending points of speech with the signal, an improvement to the means for determining the beginning and ending points of the speech comprising:

frequency means for determining a value representative of the smoothed frequency band limited energy within the input signal;

means for determining a variance of the value representative of the smoothed frequency band limited energy; and means for determining the beginning and ending points of speech within the speech signal based on the variance of smoothed frequency MTS-610 band limited energy and the history of the smoothed frequency band limited energy.

19. A device for the detection of speech in an input signal x(t), comprising:

means for determining a variance of smoothed frequency band limited energy of said input signal; and speech interval decision means for deciding start and end points of speech within the signal based on said variance and the history of the smoothed frequency band limited energy.

20. The device of claim 19, wherein said smoothed frequency band limited energy is derived from passing the input signal through a Fourier transform.

21. The device of claim 19, wherein said variance is determined from the smoothed frequency band limited energy over a continuous period of m seconds.

22. The device of claim 21, wherein m is between 0 and 10 seconds.

23. The device of claim 1, wherein the variance of smoothed frequency band limited energy is determined by maintaining a sum of m seconds of smoothed frequency band limited energy and a sum of the squares of said m seconds of smoothed frequency band limited energy and, for a new variance determination, the sum of squares of smoothed frequency band limited energy is updated by adding the square of a newest smoothed frequency band limited energy and subtracting the square of the smoothed frequency band limited energy value m seconds past, and wherein the sum of said m seconds of smoothed frequency band limited energy is updated by adding the newest smoothed frequency band limited energy and subtracting the smoothed frequency band limited energy value m seconds past.

24. The device of claim 1, including a signal recording device wherein the recording device includes:

means for receiving the signal;

means for storing the most recent m seconds of that signal; and means to select the portion of the stored signal that corresponds to start and end points determined by the device of claim 1.

25. The device of claim 1 including a signal recording device wherein the recording device includes:

means for receiving the signal;

means for storing the most recent m seconds of that signal; and means to select a portion of the signal z seconds past while simultaneously receiving the signal, where z is determined by the device of claim 1.

26. The device of claim 25, where z is between 0 and 100 seconds.

27. The device of claim 25, where m is 0 seconds or greater.

28. The device of claim 1, wherein the means for determining the value representative of the smoothed frequency band limited energy includes:

means for calculating the frequency band limited energy; and means for applying a smoothing function to the frequency band limited energy to generate the smoothed frequency band limited energy.

29. The device of claim 28, wherein the means for smoothing the frequency band limited energy comprises:

means to calculate the median of recent values representative of the frequency band limited energy.

30. The device of claim 28, wherein the means for smoothing the frequency band limited energy comprises:

means to calculate the mean of recent values representative of the frequency band limited energy.

31. The device of claim 28, wherein the means for smoothing the frequency band limited energy comprises:

means to apply a filter which suppresses quick variations of the frequency band limited energy.

32. A method for detecting speech in an input signal comprising the steps of:

a) determining a value representative of smoothed frequency band limited energy within the signal;

b) determining a variance of smoothed frequency band limited energy; and c) determining the beginning and ending points of speech within the signal based on the variance of the smoothed frequency band limited energy and past history of the smoothed frequency band limited energy.

33. The method of claim 32 in which step a) includes the steps of:

determining frequencies associated with the signal;

selecting portions of the signal having frequencies within a preselected range;

determining a value representative of the total energy within the selected portions of the signal, the value representative of total energy being the frequency band limited energy; and smoothing the frequency band limited energy, the value being the smoothed frequency band limited energy.

34. A method for detecting speech within an input signal, the method including the steps of receiving a speech signal, and determining the beginning and ending points of speech with the signal, an improvement to the step of determining the beginning and ending points of the speech comprising the steps of:

a) determining a value representative of the smoothed frequency band limited energy within the input signal;

b) determining a variance of the value representative of the smoothed frequency band limited energy; and c) determining the beginning and ending points of speech within the speech signal based on the variance of smoothed frequency band limited energy and the history of the smoothed frequency band limited energy.

35. A method for the detection of speech in an input signal x(t), comprising the steps of:

a) determining a variance of smoothed frequency band limited energy of said input signal; and b) deciding start and end points of speech within the signal based on said variance and the history of the smoothed frequency band limited energy.

* * * * *

UNITED STATES PATENT AND TRADEMARK OFFICE

CERTIFICATE OF CORRECTION

PATENT NO. : 5,826,230
DATED : October 20, 1998
INVENTOR(S) : Reaves

It is certified that error appears in the above-identified patent and that said Letters Patent is hereby corrected as shown below:

Column 9, line 19, delete "frequency".

Column 9, line 28, delete "MTS-610".

Signed and Sealed this

Sixth Day of July, 1999

*Attest:*

Q. TODD DICKINSON

*Attesting Officer*

*Acting Commissioner of Patents and Trademarks*